United States Patent [19]

Wurscher

[11] Patent Number: 4,574,529

[45] Date of Patent: Mar. 11, 1986

[54] APPARATUS FOR GRINDING TWIST DRILLS

[75] Inventor: Raimund A. Wurscher, Vienna, Austria

[73] Assignee: Intermedium AG, Kussnacht am Rigi, Switzerland

[21] Appl. No.: 700,546

[22] Filed: Feb. 11, 1985

[30] Foreign Application Priority Data

Feb. 14, 1984 [AT] Austria ..... 464/84

[51] Int. Cl.[4] ..... B24B 7/00

[52] U.S. Cl. ..... 51/128; 51/5 D; 51/73 R; 51/102; 51/219 R

[58] Field of Search ..... 51/128, 102, 73 R, 5 D, 51/219 R

[56] References Cited

U.S. PATENT DOCUMENTS

| | | | |
|---|---|---|---|
| 3,742,652 | 7/1973 | Enders | 51/128 |
| 3,753,320 | 8/1973 | Wurscher | 51/102 |
| 4,016,680 | 4/1977 | Moores et al. | 51/5 D |

*Primary Examiner*—Frederick R. Schmidt
*Assistant Examiner*—J. T. Zatarga
*Attorney, Agent, or Firm*—Kurt Kelman

[57] ABSTRACT

The apparatus for grinding twist drills comprises a shaft and a grinding wheel which has a grinding surface and is rigidly secured to the shaft. The apparatus comprises also a drill-guiding body, which faces the grinding surface and is axially spaced from it and axially immovable relative to the grinding surface. The drill-guiding body is formed with a plurality of guiding passages for guiding twist drills differing in diameter toward the grinding surface. At least one guide lug is aligned with each guiding passage of the drill-guiding body and adapted to extend into a flute of a twist drill extending through the associated guiding passage. All guide lugs are mounted on a guide lug carrier, which is mounted to be axially movable between the drill-guiding body and the grinding surface and which is biased toward the grinding surface by a spring. At least one abutment consisting of a material which has a higher hardness than the grinding wheel is secured to the guide lug carrier and has an abutment surface which is parallel to and engageable by the grinding surface. This arrangement ensures that a constant distance from the guide lugs to the grinding surface will be maintained during the grinding operation in spite of the wear of the grinding wheel and the original shape of the grinding surface will be restored.

7 Claims, 9 Drawing Figures

FIG. 2
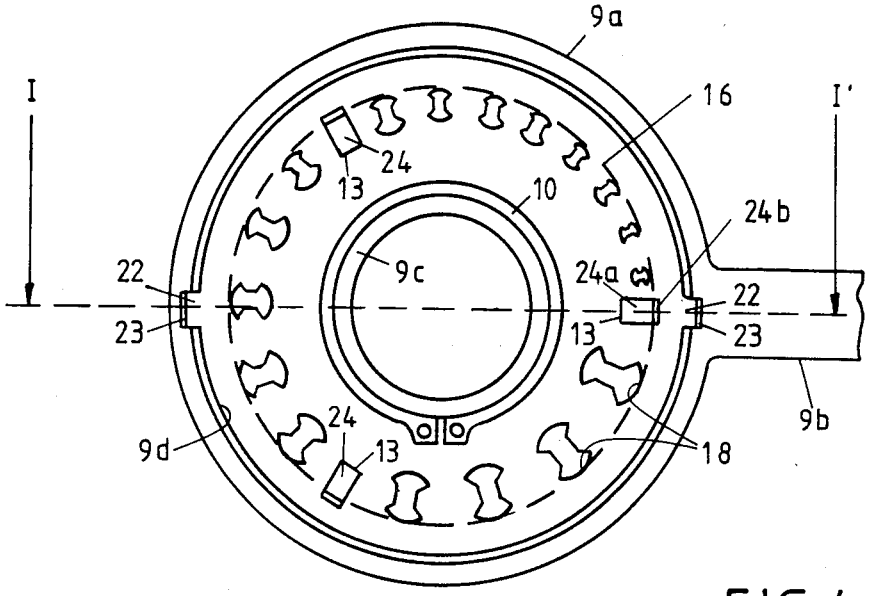
FIG. 3
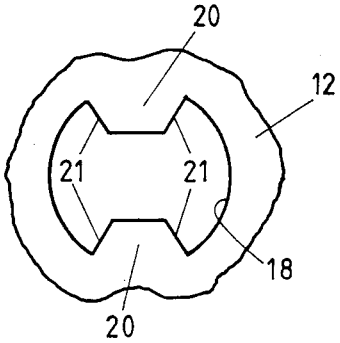
FIG. 4
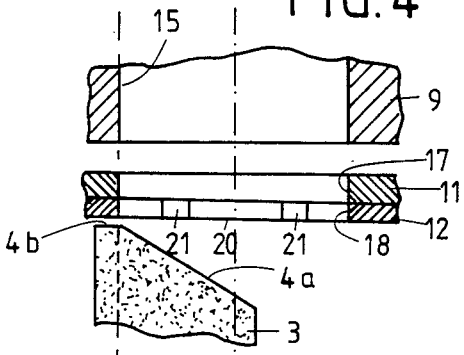
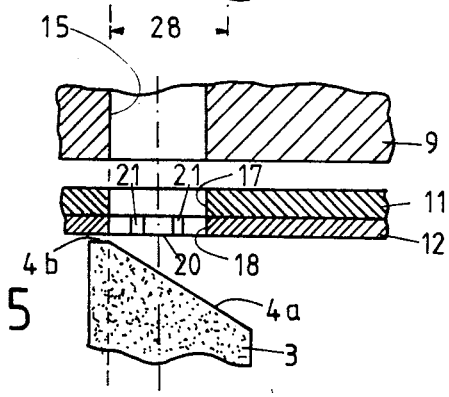
FIG. 5

APPARATUS FOR GRINDING TWIST DRILLS

BACKGROUND OF THE INVENTION

1. Field of the Invention

This invention relates to apparatus for grinding twist drills each having clearance surfaces and a helical flute associated with each clearance surface, which apparatus comprises a rotatable drive shaft, a grinding wheel having a grinding surface and rigidly connected to said drive shaft, and a drill-guiding body, which faces said grinding surface and is axially fixed relative thereto and has guiding passages differing in diameter and adapted to guide clearance surfaces of respective ones of said twist drills differing in diameter toward said grinding surface, also comprising in alignment with each of said guiding passages at least one guide projection for extending into a flute of a twist drill extending through said guiding passage, wherein all guide projections are carried by a guide projection carrier which is disposed between the drill-guiding body and the grinding surface.

2. Description of the Prior Art

Such apparatus for grinding twist drills which need not be chucked is known from U.S. Pat. No. 3,742,652. In that known apparatus the guide projection carrier is axially fixed and is pivotally movable about the axis of the drive shaft for adjusting the angular position of the guide projections relative to the guiding passages.

In a similar grinding apparatus shown in FIG. 1b of U.S. Pat. No. 3,753,320 the guide projections are rigid with a drill-guiding body, which is axially adjustable relative to the grinding surface so that the distance from the guide projections to the grinding surface can be adjusted.

In such apparatus the result of the grinding operation will decisively depend on the proper position of the clearance surface being ground relative to the grinding surface. The position of the clearance surface will depend on the angular position of the guide projection relative to the guiding passage and, owing to the helical flutes of the twist drill, also on the axial distance from the guide projection to the grinding surface.

One disadvantage of said known apparatus resides in that the axial distance from the grinding surface to the guide projections increases with the wear of said grinding surface so that the correct axial distance between the guide projections and the grinding surface must be readjusted (U.S. Pat. No. 3,753,320) or the radial position of the guide projections relative to the guide passages must be changed (U.S. Pat. No. 3,742,652).

Another disadvantage will arise during a prolonged grinding of twist drills which are so small in diameter that they will not contact the entire grinding surface during each revolution of the grinding wheel and resides in that a groove will then be formed in the grinding surface. When a twist drill larger in diameter is subsequently ground, that groove will be reflected by the clearance surface that has been ground, i.e. by the cutting edge of such larger drill, and the grinding wheel cannot be used any longer when such groove has reached a certain size.

SUMMARY OF THE INVENTION

It is an object of the invention to provide apparatus which is of the kind described first hereinbefore and which can be used to grind twist drills differing in diameter without chucking said drills and in which the correct axial distance from the grinding surface to the guide projections and the original shape of the grinding surface will be continuously maintained.

In apparatus of the kind described first hereinbefore that object is accomplished in accordance with the invention in that the guide projection carrier is axially movably mounted between the drill-guiding body and the grinding surface and is biased toward the grinding surface by a spring and at least one abutment is secured to the guide projection carrier and is made of a material that has a higher hardness than the grinding wheel, e.g., of a hard metal or cermet, such as cemented carbides, and which has an abutment surface that faces and is parallel to and engageable by the grinding surface and arranged to limit the spring-urged movement of the guide projection carrier toward the grinding surface.

In such apparatus the axial distance between each guide projection and the grinding surface will remain constant in spite of the wear of the grinding wheel and damage to the guide projections by the grinding wheel will be precluded.

Because the rotating grinding wheel will be worn not only in contact with the drills but also in contact with the abutments, the grinding surface will be continuously restored to the shape of the abutment surfaces so that the original shape of the grinding surface will be continuously maintained and a deformation of the grinding surface will be prevented.

It might be criticized that the abutments will blunt the abrasive particles in the grinding surface so that their abrasive action will be decreased. In fact, it can be shown that such blunting will take place quickly. But it can also be shown that such blunted grinding surface will soon be resharpened when it is used to grind without contacting such abutments.

Within the scope of the invention such undesired influence of the abutments on the grinding action of the grinding wheel can be avoided to a large extent.

For instance, in an embodiment of the invention the radial dimensions of the grinding surface and of the abutment surfaces are larger than is required for the grinding of the largest twist drill which can be received by any guiding passage of the apparatus and said radial dimensions and the force of the spring are so matched that the contact pressure between said radially protruding portions is lower than the average grinding pressure to be expected between the clearance surface of a twist drill and the grinding surface. In this connection it must be borne in mind that the grinding pressure is exerted by hand and the wear of the grinding surface increases with that pressure.

The feature which has just been described will be most successful in apparatus in which the grinding surface is conical and the guiding passages are at least approximately parallel to the axis of the drive shaft and at least approximately adjoin an imaginary cylindrical surface that is coaxial to the shaft and is disposed radially outwardly of the guiding passages if the grinding surface is the inside surface of a hollow cone and radially inwardly of the guiding passages if the grinding passage is the outside surface of a cone.

The effect of such arrangements will be explained with reference to the following example.

If a twist drill 4 mm in diameter is ground in drill-grinding apparatus having a blunt hollow conical grinding surface and the contact pressure between the abutment surface and the grinding surface is lower than the grinding pressure between the drill and the grinding surface, that portion of the grinding surface that is contacted by the twist drill in a width of about 2 mm will wear faster and will clear the abutments and will thus be sharpened.

That sharpened portion is disposed in the outermost portion of the hollow-conical grinding surface. When a twist drill 8 mm in diameter is subsequently ground, the innermost portion of its clearance surface, in a width of 2 mm, will be ground by the blunted region of the grinding surface so that region will also be sharpened during the grinding operation, and the outermost portion of the clearance surface, in a width of 2 mm, will be ground by the sharp portion of the grinding surface. Owing to the special geometry of twist drills, about two-thirds of the area of the clearance surface of the 8 mm drill will be disposed in said outermost portion. As a result, even at the beginning of the grinding operation the full grinding action will be achieved on two-thirds of the area of the clearance surface of the 8 mm drill. Whereas a deformation of the grinding surface cannot be entirely avoided in that case it has been found in practice that that deformation will be within very small limits if the force of the spring and the area of the abutment surface are properly selected.

In an embodiment of the invention a stop is provided, which is secured to the drill-guiding body or to a structure that is rigid with the drill-guiding body, and said stop is axially adjustable and arranged to limit the spring-urged movement of the guide projection carrier toward the grinding surface so that the distance from the guide projection carrier to the grinding surface can be adjusted.

In such apparatus the distance from the guide projections to the grinding surface can be adjusted to any desired value between a position in which the abutment engages the grinding surface and a position in which the guide projection carrier engages the drill-guiding body. In such apparatus the positions of the clearance surfaces of the twist drills relative to the grinding surface may be selected within a wide range so that the cutting edges can be ground to different clearance angles.

The abutments will usually be made of hard metal or cermets, such as cemented carbides. Hard metal or cermets will suffer only a negligibly small wear in contact with grinding wheels made of alumina, such as are usually employed to grind twist drills of the kind discussed here.

Experience has shown that even a relatively small difference in abrasive hardness between the hard metal and the abrasive particles of the grinding wheel will provide a satisfactory ratio of the wear of the grinding wheel and the wear of the abutments. In general, the abutments must be made of a material which has a higher hardness than the grinding wheel, the hardness of the grinding wheel being the strength with which the binding agent retains the abrasive particles in the grinding surface.

The abutments may be made of materials other than hard metal or cermets, for instance from polycrystalline diamond (milligrain diamond) or from cubic boron nitride (CBN). Abutments made of such material may be used with grinding wheels incorporating abrasive materials which are harder than alumina, such as silicon carbide.

BRIEF DESCRIPTION OF THE DRAWINGS

FIG. 2 is an elevation showing the guide lug carrier and the drill-guiding body viewed in the direction of the arrow A in FIG. 1.

FIG. 3 is an enlarged view showing a pair of guide lugs.

FIGS. 4 and 5 are enlarged sectional views showing the drill-guiding body, the guide lug carrier and the grinding disc adjacent to the largest and smallest guiding passages.

DETAILED DESCRIPTION OF PREFERRED EMBODIMENTS

Figure 1:
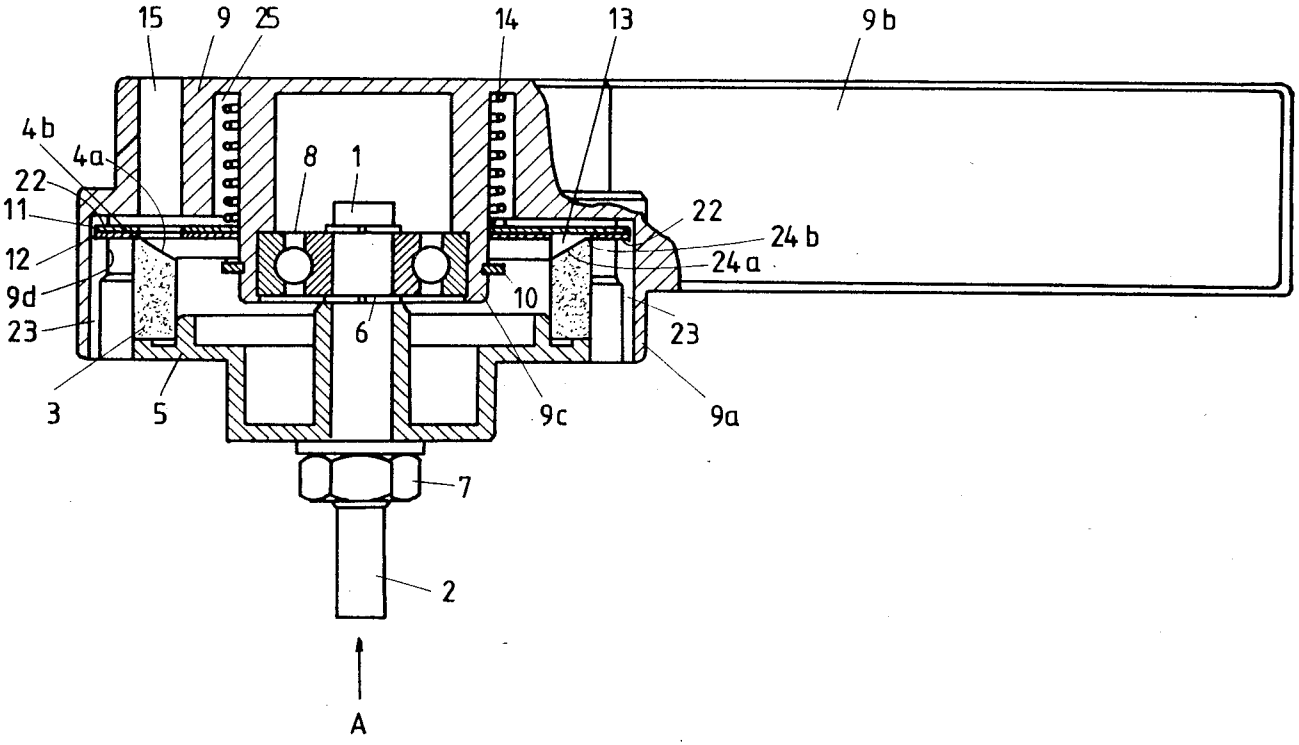
FIG. 1 is a longitudinal sectional view taken on line plane I—I' in FIG. 2 and showing drill-grinding apparatus embodying the invention.
Figure 6:
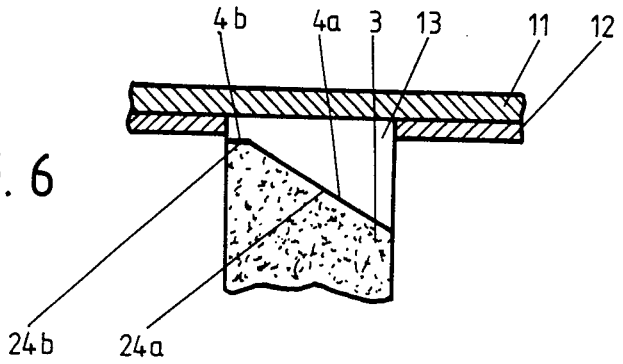
FIG. 6 is a sectional view which is similar to FIGS. 4 and 5 but shows the structure adjacent to an abutment.
Figure 7:
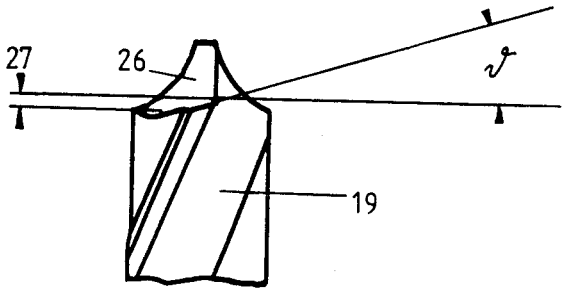
FIG. 7 shows the tip portion of a conventional twist drill.

Two illustrative embodiments of the invention will now be described in more detail with reference to the drawing In the embodiment shown in FIGS. 1 to 8, a drive shaft 1 has an extension pin 2, which is adapted to be gripped in the chuck of a drilling machine, not shown.

A grinding wheel 3 is adhesively bonded to the grinding wheel carrier 5, which is gripped on the drive shaft 1 between a retaining ring 6 and a nut 7.

The retaining ring is secured to the shaft 1 and the nut is in threaded engagement with mating screw shafts on the shaft 1. The grinding wheel 3 has an annular grinding surface portion 4*a* for engaging the clearance surfaces of the twist drills. That grinding surface portion 4*a* is hollow-conical and is adjoined on the outside by an annular grinding surface portion 4*b*, which lies in a plane that is at right angles to the axis of the drive shaft 1.

The drive shaft 1 is rotatably mounted in a ball-bearing assembly 8, which is mounted in a hollow-cylindrical portion 9*c* of a drill-guiding body 9, which is axially spaced from and faces the grinding surface portion 4*a*.

The drill-guiding body 9 is formed with a plurality of guiding passages 15, which are parallel to the axis of the shaft 1 and differ in diameter and serve to guide twist drills differing in diameter to the grinding surface 4*a*. The guiding passages 15 lie inside a circle 16 (FIG. 2), which is tangent to all guiding passages and has a diameter that is equal to the outside diameter of the grinding surface portion 4*a*. The drill-guiding body 9 centered on the axis of the grinding wheel also comprises a hollow-cylindrical extension 9*a*, which surrounds the grinding wheel 3. The drill-guiding body 9 is integrally formed with a handle 9*b*. The hollow-cylindrical portion 9*c* of the drill-guiding body 9 is formed in its outside surface with an annular groove, in which a retaining ring 10 is secured.

Figure 8:
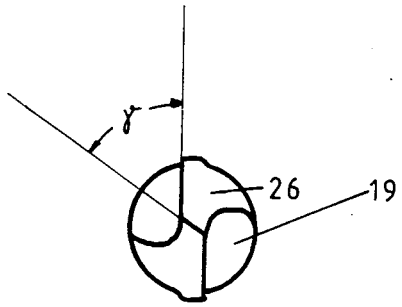
FIG. 8 is a top plan view showing the twist drill tip portion of FIG. 7.

A guide lug carrier comprises two substantially annular discs 11 and 12, which are rigidly interconnected. The disc 11 is formed with bores 17, which are aligned with respective guiding passages 15 and are equal in diameter to the corresponding guiding passages 15. The disc 12 has openings 18 aligned with respective bores 17. Two guide lugs 20 (FIG. 3) project into each opening 18 and are arranged to slidably extend with an angular play into respective flutes 19 of a twist drill which extends through the associated guiding passage 15 (FIG. 8). Each guide lug 20 is formed on opposite radial sides with two edge faces 21 for limiting the rotation in the clockwise and counterclockwise senses of a twist drill that extends through the associated guiding passage 15 and between the guide lugs 20. Two diametrically opposite lugs or ribs 22 of the guide lug carrier 11, 12 extend outwardly into mating grooves 23 formed in the hollow-cylindrical extension 9*a* to ensure that the openings 20 and 21 of the guide lug carrier 11, 12 will be exactly aligned with respective guiding passages 15 of the body 9. The guide lug carrier 11, 12 is axially movably mounted on the drill-guiding body 9 in that the substantially cylindrical outside peripheral surface of the guide lug carrier is in sliding contact with a cylindrical inside surface 9*d* of the drill-guiding body 9.

Three abutments 13 consisting of hard metal or cermets are soldered to the guide lug carrier 11, 12 on that side thereof which faces the grinding wheel and are regularly spaced apart in the peripheral direction. Each of said abutments 13 comprises an abutment surface 24*a* which faces and is parallel to the grinding surface portion 4*a*, and an abutment surface 24*b*, which extends radially outwardly of the abutment surface 24*a* and faces and is parallel to the radially outer annular portion 4*b* of the grinding surface.

A compression spring 14 bears at one end on the bottom of an annular recess 25 formed in the drill-guiding body 9 and at the other end on the guide lug carrier 11, 12 so that the abutments 13 carried by the guide lug carrier 11, 12 are urged against the grinding surface 4*a*, 4*b* by the force of that spring.

The embodiment described hereinbefore has the following mode of operation:

The extension pin 2 of the shaft 1 is chucked in the chuck of a hand-held electric drilling machine. The resulting assembly is held by means of one hand at the handle 9*b*. Then the drilling machine is started so that the rotation of the chuck is transmitted by the shaft 1 and the grinding wheel carrier 5 to the grinding wheel 3. The twist drill to be ground is pushed with the other hand into the narrowest guiding passage 15 which can receive that drill and is moved to extend the guide lugs 20 associated with said guiding passage 19 until one clearance surface 26 of said twist drill bears on the grinding surface portion 4*a*. The twist drill is urged against the grinding surface portion 4*a* under slight, uniform pressure and at the same time is caused to perform a plurality of angular oscillations to the right and left between the edge faces 21 of the guide lugs 20. Thereafter the twist drill is axially retracted from the guide lugs 20 and is then rotated through about 180° and the procedure described hereinbefore is repeated to grind the other clearance surface 26 of the drill. The two grinding cycles which have been described hereinbefore may be repeated until the twist drill has been ground as desired.

The twist drill has thus been concentrically ground to tolerances which are satisfactory in practice and its clearance surfaces have been ground so that the twist drill has an adequate clearance 27 (FIG. 7), a desired clearance angle $\delta$ (FIG. 7) and a desired chisel edge angle $\gamma$ (FIG. 8). If a larger clearance etc. is desired, the twist drill to be ground will be inserted into the next wider guiding passage 15.

During the grinding operation that region of the grinding surface portion 4*a* which is contacted by the twist drill is worn by the twist drill and at least that grinding surface portion which is not contacted by the twist drill is worn by the abutments 13 so that a deformation of the grinding surface will be prevented. On the other hand, that grinding surface portion which is contacted by the abutments will be blunted so that it will lose part of its grinding action.

Experience has shown that the force exerted on the twist drill being ground increases with the diameter of the twist drill so that the grinding pressure between the grinding surface portion 4*a* and the clearance surface 26 of the drill will be approximately the same with drills differing in diameter, i.e., that pressure will be independent on the diameter of the twist drill. It may also be assumed that the average grinding pressure induced by different persons in practice will lie within a relatively narrow range.

The radial width of the radially outer grinding surface portion 4*b*, the area of each radially outer abutment surface 24*b* and the force of the spring 14 can be so matched that the contact pressure between the surfaces 4*b*, 24*b* will be lower than said average grinding pressure which is to be expected and that in that case that strip of the grinding surface portion 4*a* which is contacted by a given twist drill will be worn faster so that is will clear the abutment surface 24*a* and will be sharpened.

It is apparent from FIGS. 2, 4 and 5 that any twist drill being ground will be tangent to the outside diameter of the grinding surface portion 4*a* so that that sharp region will adjoin the outside periphery of the grinding surface portion 4*a*.

If the apparatus described hereinbefore is designed, e.g., to grind drills 3 mm to 10 mm in diameter, the radial width 28 (FIG. 4) of the grinding surface portion 4*a* will be 5 mm. Because the apparatus will probably be used to grind twist drills differing in diameter, a strip having a radial width of about 2.5 mm will be sharp. As that sharp strip adjoins the outside diameter of said grinding surface portion 4*a*, about two-thirds of the total clearance surface area of a 10-mm twist drill being ground will be disposed in that sharp region owing to the special geometry of twist drills.

The spring 14 biasing the guide lug carrier 11, 12 constantly forces the abutments 13 against the grinding surface portion 4*a*. As a result, the distance from the guide lugs 20 to the grinding surface portion 4*a* will remain substantially constant in spite of the wear of the grinding wheel. For this reason, twist drills can be ground with substantially the same results until the guide lug carrier 11, 12 engages the retaining ring 10. Then the grinding wheel must be replaced.

Figure 9:
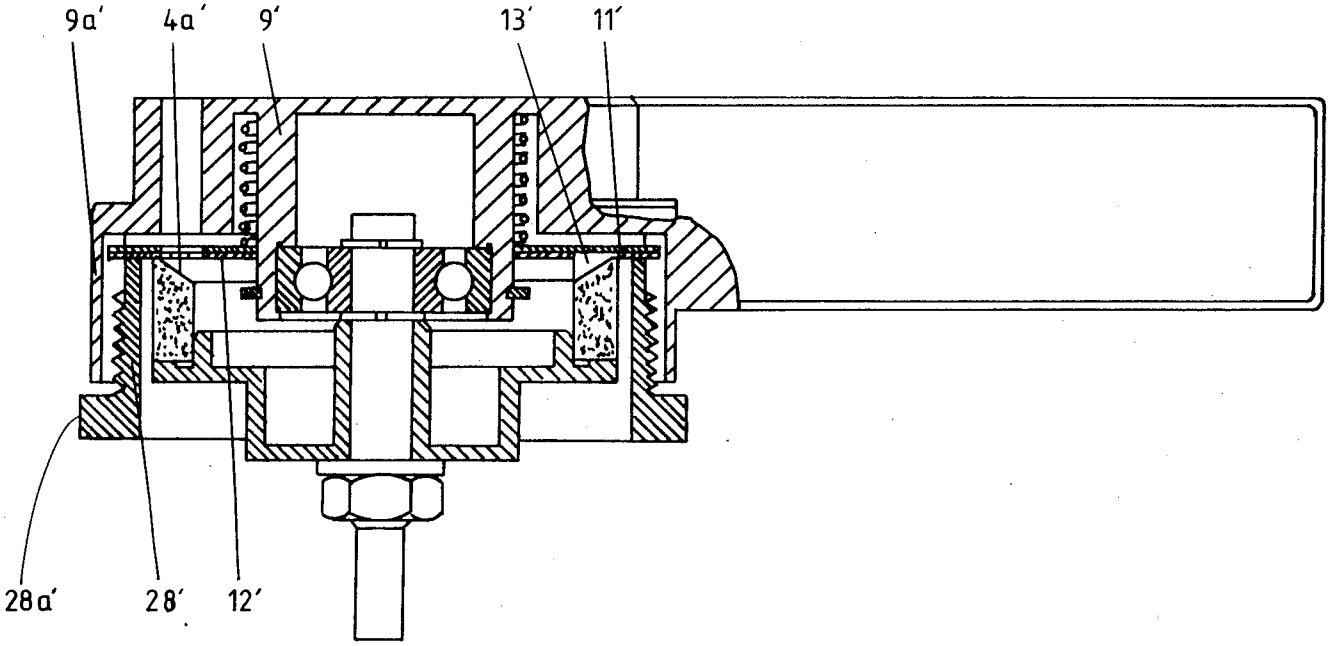
FIG. 9 is a longitudinal sectional view which is similar to FIG. 1 and shows a second embodiment of the invention.

The embodiment shown in FIG. 9 comprises a stop ring 28', which is provided with external screw threads in threaded engagement with internal screw threads formed on the hollow-cylindrical extension 9*a'* of the drill-guiding body 9'. All other parts of this embodiment are identical to the corresponding parts of the illustrative embodiment described hereinbefore.

The guide lug carrier 11', 12' engages the top rim of the stop ring 28'. The protruding portion 28*a'* of the stop ring 28' can be rotated in one sense or the other to axially move the guide lug carrier 11', 12 between two end positions. In one end position the abutments 13' engage the grinding surface portion 4a'. In the other end position the guide lug carrier 11', 12' engages the drillguiding body 9'.

As has been mentioned hereinbefore the position of the clearance surfaces of each twist drill relative to the grinding surface will depend on the axial distance from the guide lugs to the grinding surface. For this reason an apparatus as shown in FIG. 9 can be adjusted to change the positions of the clearance surfaces of the twist drills in a range which is determined by the distance between the end positions of the guide lug carrier 11', 12' and different clearances 27, clearance angles $\theta$ and chisel edge angles $\gamma$ can thus be obtained.

Two illustrative embodiments of the invention have been described hereinbefore but the invention is by no means restricted to those embodiments. For instance, the illustrative embodiments which have been described are designed as attachments for a hand-held drilling machine. Alternatively, the invention might be embodied in a self-contained unit which incorporates a motor.

It is believed that a satisfactory result as regards the grinding action of the grinding wheel on the twist drills and as regards the action of the abutments on the grinding surface will be produced by the use of the features of the invention if the grinding surface in contact with the twist drill revolves at a surface speed of about 3 to 30 meters per second and that optimum results will be produced at a surface speed of about 20 meters per second. With a grinding wheel having an outside diameter of about 80 mm, said surface speeds correspond to speeds in the range from about 700 to 7000 r.p.m. or to an optimum speed of 5000 r.p.m.

The embodiments of the invention in which an exclusive property or privilege is claimed are defined as follows:

1. In apparatus for grinding twist drills having clearance surfaces and helical flutes associated with respective ones of said clearance surfaces, comprising a rotatable drive shaft, a grinding wheel, which has an annular grinding surface and is rigidly secured to said shaft, a drill-guiding body, which is axially spaced apart from said grinding surface at a fixed distance therefrom and defines plurality of peripherally spaced apart guiding passages which are different in diameter and open at one end which is spaced from and faces said grinding surface and at the opposite end and are adapted each to receive a twist drill in a position in which one clearance surface of said twist drill contacts said grinding surface in a portion thereof which is axially aligned with said guiding passage, and a guide projection carrier, which is disposed between said drill-guiding body and said guiding surface and comprises in axial alignment with each of said guiding passages at least one guide projection, which is adapted to extend into one of said flutes of a twist drill extending through said guiding passage, the improvement residing in that said guide projection carrier is axially movably mounted between said drill-guiding body and said grinding surface, spring means are provided for axially urging said guide projection carrier toward said grinding surface, and at least one abutment consisting of a material which has a higher hardness than said grinding wheel at said grindind surface is secured to said guide projection carrier and has an abutment surface which faces and is parallel to said grinding surface and is engageable by the latter to limit the axial movement of said guide projection carrier toward said grinding surface.

2. The improvement set forth in claim 1, wherein the radial dimensions of the grinding surface and of the abutment surfaces are larger than is required for the grinding of the largest twist drill which can be received by any guiding passage of the apparatus and said radial dimensions and the force of the spring are so matched that the contact pressure between said radially protruding portions is lower than the average grinding pressure to be expected between the clearance surface of a twist drill and the grinding surface.

3. The improvement set forth in claim 2 as applied to apparatus in which guiding passages extend at least substantially parallel to the axis of said shaft and adjoin an imaginary cylindrical surface which is coaxial to said shaft, wherein said grinding surface constitutes an inside surface portion of a hollow cone and said cylindrical surface surrounds said guiding passages.

4. The improvement set forth in claim 2 as applied to apparatus in which guiding passages extend at least substantially parallel to the axis of said shaft and adjoin an imaginary cylindrical surface which is coaxial to said shaft, wherein said grinding surface constitutes an outside surface portion of a cone and said guiding passages are spaced around said cylindrical surface.

5. The improvement set forth in claim 1, wherein a stop is provided, which is axially adjustable relative to said drill-guiding body and disposed on that side of said guide projection carrier which faces said grinding surface and said stop is engageable by said guide projection carrier under the action of said spring means to limit the distance from said guide projection carrier to said grinding surface.

6. The improvement set forth in claim 5, wherein said stop is axially adjustably mounted on said drill-guiding body.

7. The improvement set forth in claim 5 as applied to apparatus comprising structure which is rigidly connected to said drill-guiding body, wherein said stop is axially adjustably mounted on said structure.

* * * * *